US008102319B2

(12) United States Patent
Schlub et al.

(10) Patent No.: US 8,102,319 B2
(45) Date of Patent: Jan. 24, 2012

(54) HYBRID ANTENNAS FOR ELECTRONIC DEVICES

(75) Inventors: Robert W. Schlub, Campbell, CA (US); Qingxiang Li, Mountain View, CA (US); Juan Zavala, Watsonville, CA (US); Robert J. Hill, Salinas, CA (US)

(73) Assignee: Apple Inc., Cupertino, CA (US)

( * ) Notice: Subject to any disclaimer, the term of this patent is extended or adjusted under 35 U.S.C. 154(b) by 873 days.

(21) Appl. No.: 12/120,008

(22) Filed: May 13, 2008

(65) Prior Publication Data

US 2009/0256758 A1 Oct. 15, 2009

Related U.S. Application Data

(60) Provisional application No. 61/044,456, filed on Apr. 11, 2008.

(51) Int. Cl.
*H01Q 1/24* (2006.01)

(52) U.S. Cl. ..... 343/702; 343/767

(58) Field of Classification Search ..... 343/702, 343/767, 700 MS

See application file for complete search history.

(56) References Cited

U.S. PATENT DOCUMENTS

| | | | | |
|---|---|---|---|---|
| 4,894,663 | A | 1/1990 | Urbish et al. | |
| 4,980,694 | A | 12/1990 | Hines | |
| 5,021,010 | A | 6/1991 | Wright | |
| 5,041,838 | A | 8/1991 | Liimatainen et al. | |
| 5,048,118 | A | 9/1991 | Brooks et al. | |
| 5,258,772 | A * | 11/1993 | Inanaga et al. | 343/895 |
| 5,383,098 | A * | 1/1995 | Ma et al. | 361/818 |
| 5,561,437 | A | 10/1996 | Phillips et al. | |
| 5,754,143 | A | 5/1998 | Warnagiris et al. | |
| 5,798,984 | A | 8/1998 | Koch | |
| 6,011,699 | A | 1/2000 | Murray et al. | |
| 6,097,345 | A | 8/2000 | Walton | |
| 6,337,662 | B1 | 1/2002 | Cassel | |
| 6,622,031 | B1 | 9/2003 | McCleary et al. | |
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,856,294 | B2 | 2/2005 | Kadambi et al. | |
| 6,968,508 | B2 | 11/2005 | Lucaci et al. | |
| 6,980,154 | B2 | 12/2005 | Vance et al. | |

(Continued)

OTHER PUBLICATIONS

Hill et al. U.S. Appl. No. 11/821,192, filed Jun. 21, 2007.

(Continued)

*Primary Examiner* — Tho G Phan

(74) *Attorney, Agent, or Firm* — Treyz Law Group; G. Victor Treyz; David C. Kellogg

(57) ABSTRACT

A portable electronic device is provided that has a hybrid antenna. The hybrid antenna may include a slot antenna structure and a planar inverted-F antenna structure. The planar inverted-F antenna structure may be formed from traces on a flex circuit substrate. A backside trace may form a series capacitance for the planar inverted-F antenna structure. The antenna slot may have a perimeter that is defined by the location of conductive structures such as flex circuits, metal housing structures, a conductive bezel, printed circuit board ground conductors, and electrical components. Springs may be used in electrically connecting these conductive elements. A spring-loaded pin may be used as part of an antenna feed conductor. The pin may connect a transmission line path on a printed circuit board to the planar inverted-F antenna structure while allowing the planar inverted-F antenna structure to be removed from the device for rework or repair.

14 Claims, 15 Drawing Sheets

U.S. PATENT DOCUMENTS

| | | | | |
|---|---|---|---|---|
| 7,027,838 | B2 | 4/2006 | Zhou et al. | |
| 7,116,267 | B2 | 10/2006 | Lee | |
| 7,119,747 | B2 | 10/2006 | Lin et al. | |
| 7,570,218 | B2 * | 8/2009 | Tsujimura et al. | 343/702 |
| 7,889,139 | B2 * | 2/2011 | Hobson et al. | 343/702 |
| 7,911,387 | B2 * | 3/2011 | Hill et al. | 343/700 MS |
| 7,933,123 | B2 * | 4/2011 | Wang et al. | 361/679.56 |
| 2003/0107518 | A1 | 6/2003 | Li et al. | |
| 2004/0145521 | A1 | 7/2004 | Hebron et al. | |
| 2006/0055606 | A1 | 3/2006 | Boyle | |
| 2008/0231521 | A1 | 9/2008 | Anguera Pros et al. | |

OTHER PUBLICATIONS

Hill et al. U.S. Appl. No. 11/821,363, filed Jun. 21, 2007.
Hobson et al. U.S. Appl. No. 60/883,587, filed Jan. 5, 2007.
Hill et al. U.S. Appl. No. 11/897,033, filed Aug. 28, 2007.
Schlub et al. U.S. Appl. No. 11/650,071, filed Jan. 4, 2007.
Schlub et al. U.S. Appl. No. 11/650,187, filed Jan. 4, 2007.
Zhang et al. U.S. Appl. No. 11/895,053, filed Aug. 22, 2007.
Zhang et al. U.S. Appl. No. 11/890,865, filed Aug. 7, 2007.

* cited by examiner

HYBRID ANTENNAS FOR ELECTRONIC DEVICES

This application claims the benefit of provisional patent application No. 61/044,456, filed Apr. 11, 2008, which is hereby incorporated by reference herein in its entirety.

BACKGROUND

This invention relates generally to electronic devices, and more particularly, to antennas for electronic devices such as portable electronic devices.

Handheld electronic devices and other portable electronic devices are becoming increasingly popular. Examples of handheld devices include handheld computers, cellular telephones, media players, and hybrid devices that include the functionality of multiple devices of this type. Popular portable electronic devices that are somewhat larger than traditional handheld electronic devices include laptop computers and tablet computers.

Due in part to their mobile nature, portable electronic devices are often provided with wireless communications capabilities. For example, handheld electronic devices may use long-range wireless communications to communicate with wireless base stations. Cellular telephones and other devices with cellular capabilities may communicate using cellular telephone bands at 850 MHz, 900 MHz, 1800 MHz, and 1900 MHz. Portable electronic devices may also use short-range wireless communications links. For example, portable electronic devices may communicate using the Wi-Fi® (IEEE 802.11) bands at 2.4 GHz and 5.0 GHz and the Bluetooth® band at 2.4 GHz. Data communications are also possible at 2100 MHz.

To satisfy consumer demand for small form factor wireless devices, manufacturers are continually striving to reduce the size of components that are used in these devices while providing enhanced functionality. Significant enhancements may be difficult to implement, however, particularly in devices in which size and weight are taken into consideration. For example, it can be particularly challenging to form antennas that operate in desired communications bands while fitting the antennas within the case of a compact portable electronic device.

It would therefore be desirable to be able to provide portable electronic devices with improved wireless communications capabilities.

SUMMARY

A portable electronic device such as a handheld electronic device is provided that may include a hybrid antenna. The handheld electronic device may be formed from two portions. A first portion may include components such as a display and a touch sensor. A second portion may include components such as a camera, printed circuit boards, a battery, flex circuits, a subscriber identity module structure, an audio jack, and a conductive bezel.

The hybrid antenna may include a slot antenna structure and a planar inverted-F antenna structure. The planar inverted-F antenna structure may be formed from traces on a flex circuit substrate. A backside trace that overlaps the other traces on the flex circuit substrate may form a series capacitance for the planar inverted-F antenna structure.

The antenna slot may have a perimeter that is defined by the location of conductive structures such as flex circuits, metal housing structures, a conductive bezel, printed circuit board conductive regions (e.g., layers of metal and other ground conductors), and electrical components. Isolation elements may be used to prevent certain conductive structures from affecting the slot perimeter when the antenna handles radio-frequency signals.

Springs may be used in electrically connecting conductive elements associated with the antenna. For example, a spring may be used to connect a conductive midplate that forms part of the first portion of the device to the conductive bezel. A second spring may be used to electrically connect a transmission line ground conductor on a printed circuit board to the conductive bezel. The edges of the printed circuit board and midplate may be aligned and may help define the antenna slot edge.

A spring-loaded pin may be used as part of an antenna feed conductor. The pin may connect a transmission line path on a printed circuit board to the planar inverted-F antenna structure. The pin may make contact with the printed circuit board at a pad that allows the planar inverted-F antenna structure to be removed from the device for rework or repair without damaging the printed circuit board.

Further features of the invention, its nature and various advantages will be more apparent from the accompanying drawings and the following detailed description of the preferred embodiments.

DETAILED DESCRIPTION

The present invention relates generally to electronic devices, and more particularly, to portable electronic devices such as handheld electronic devices.

The electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices may be wireless electronic devices.

The wireless electronic devices may be, for example, handheld wireless devices such as cellular telephones, media players with wireless communications capabilities, handheld computers (also sometimes called personal digital assistants), remote controllers, global positioning system (GPS) devices, and handheld gaming devices. The wireless electronic devices may also be hybrid devices that combine the functionality of multiple conventional devices. Examples of hybrid portable electronic devices include a cellular telephone that includes media player functionality, a gaming device that includes a wireless communications capability, a cellular telephone that includes game and email functions, and a portable device that receives email, supports mobile telephone calls, has music player functionality and supports web browsing. These are merely illustrative examples.

Figure 1:
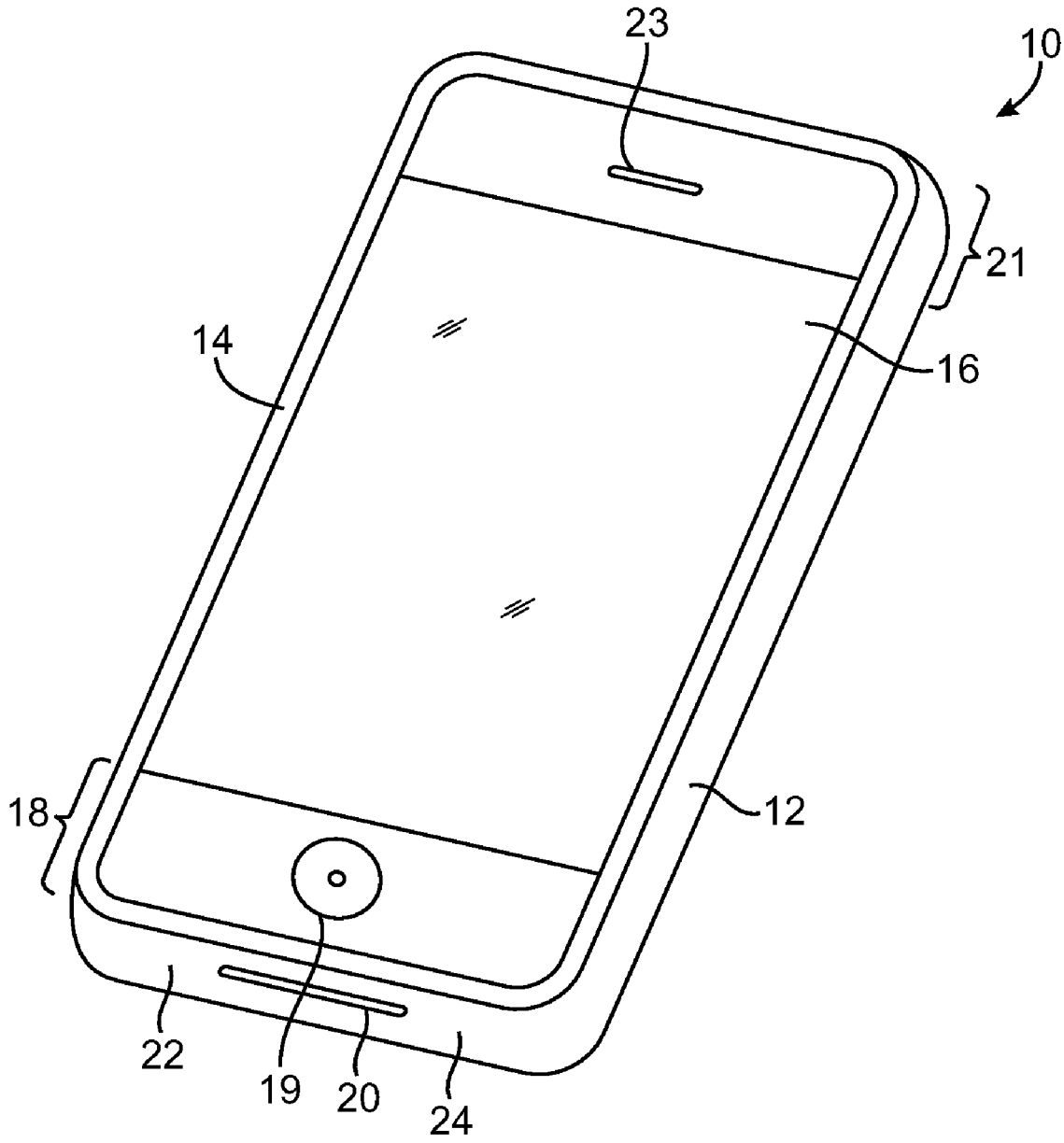
FIG. 1 is a perspective view of an illustrative portable electronic device in accordance with an embodiment of the present invention.

An illustrative portable electronic device in accordance with an embodiment of the present invention is shown in FIG. 1. Device 10 of FIG. 1 may be, for example, a handheld electronic device that supports 2G and/or 3G cellular telephone and data functions, global positioning system capabilities, and local wireless communications capabilities (e.g., IEEE 802.11 and Bluetooth®) and that supports handheld computing device functions such as internet browsing, email and calendar functions, games, music player functionality, etc.

Device 10 may have housing 12. Antennas for handling wireless communications may be housed within housing 12 (as an example).

Housing 12, which is sometimes referred to as a case, may be formed of any suitable materials including, plastic, glass, ceramics, metal, or other suitable materials, or a combination of these materials. In some situations, housing 12 or portions of housing 12 may be formed from a dielectric or other low-conductivity material. Housing 12 or portions of housing 12 may also be formed from conductive materials such as metal. An advantage of forming housing 12 from a dielectric material such as plastic is that this may help to reduce the overall weight of device 10 and may avoid potential interference with wireless operations.

In scenarios in which housing 12 is formed from metal elements, one or more of the metal elements may be used as part of the antennas in device 10. For example, metal portions of housing 12 may be shorted to an internal ground plane in device 10 to create a larger ground plane element for that device 10.

Housing 12 may have a bezel 14. The bezel 14 may be formed from a conductive material or other suitable material. Bezel 14 may serve to hold a display or other device with a planar surface in place on device 10 and may serve to form an esthetically pleasing trim around the edge of device 10. As shown in FIG. 1, for example, bezel 14 may be used to surround the top of display 16. Bezel 14 and other metal elements associated with device 10 may be used as part of the antennas in device 10. For example, bezel 14 may be shorted to printed circuit board conductors or other internal ground plane structures in device 10 to create a larger ground plane element for device 10.

Display 16 may be a liquid crystal display (LCD), an organic light emitting diode (OLED) display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

Display screen 16 (e.g., a touch screen) is merely one example of an input-output device that may be used with electronic device 10. If desired, electronic device 10 may have other input-output devices. For example, electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 22 and 24 may, if desired, form speaker and microphone ports. Speaker port 22 may be used when operating device 10 in speakerphone mode. Opening 23 may also form a speaker port. For example, speaker port 23 may serve as a telephone receiver that is placed adjacent to a user's ear during operation. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of electronic device 10 may supply input commands using user input interface devices such as button 19 and touch screen 16. Suitable user input interface devices for electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown schematically as being formed on the top face of electronic device 10 in the example of FIG. 1, buttons such as button 19 and other user input interface devices may generally be formed on any suitable portion of electronic device 10.

For example, a button such as button 19 or other user interface control may be formed on the side of electronic device 10. Buttons and other user interface controls can also be located on the top face, rear face, or other portion of device 10. If desired, device 10 can be controlled remotely (e.g., using an infrared remote control, a radio-frequency remote control such as a Bluetooth® remote control, etc.).

Electronic device 10 may have ports such as port 20. Port 20, which may sometimes be referred to as a dock connector, 30-pin data port connector, input-output port, or bus connector, may be used as an input-output port (e.g., when connecting device 10 to a mating dock connected to a computer or other electronic device). Port 20 may contain pins for receiving data and power signals. Device 10 may also have audio and video jacks that allow device 10 to interface with external components. Typical ports include power pins to recharge a battery within device 10 or to operate device 10 from a direct current (DC) power supply, data pins to exchange data with external components such as a personal computer or peripheral, audio-visual jacks to drive headphones, a monitor, or other external audio-video equipment, a subscriber identity module (SIM) card port to authorize cellular telephone service, a memory card slot, etc. The functions of some or all of these devices and the internal circuitry of electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of electronic device 10 to function properly without being disrupted by the electronic components.

Examples of locations in which antenna structures may be located in device 10 include region 18 and region 21. These are merely illustrative examples. Any suitable portion of device 10 may be used to house antenna structures for device 10 if desired.

Any suitable antenna structures may be used in device 10. For example, device 10 may have one antenna or may have multiple antennas. The antennas in device 10 may each be used to cover a single communications band or each antenna may cover multiple communications bands. If desired, one or more antennas may cover a single band while one or more additional antennas are each used to cover multiple bands. As an example, a pentaband cellular telephone antenna may be provided at one end of device 10 (e.g., in region 18) and a dual band GPS/Bluetooth®/IEEE-802.11 antenna may be provided at another end of device 10 (e.g., in region 21). These are merely illustrative arrangements. Any suitable antenna structures may be used in device 10 if desired.

In arrangements in which antennas are needed to support communications at more than one band, the antennas may have shapes that support multi-band operations. For example, an antenna may have a resonating element with arms of various different lengths. Each arm may support a resonance at a different radio-frequency band (or bands). The antennas may be based on slot antenna structures in which an opening is formed in a ground plane. The ground plane may be formed, for example, by conductive components such as a display, printed circuit board conductors, flex circuits that contain conductive traces (e.g., to connect a camera or other device to integrated circuits and other circuitry in device 10), a conductive bezel, etc. A slot antenna opening may be formed by arranging ground plane components such as these so as to form a dielectric-filled (e.g., an air-filled and/or plastic-filled) space. A conductive trace (e.g., a conductive trace with one or more bends) or a single-arm or multiarm planar inverted-F antenna may be used in combination with an antenna slot to provide a hybrid antenna with enhanced frequency coverage. Inverted-F antenna elements or other antenna structures may also be used in the presence of an antenna slot to form a hybrid slot/non-slot antenna.

When a hybrid antenna structure is formed that has an antenna slot and a non-slot antenna resonating element, the slot may, if desired, contribute a frequency response for the antenna in a one frequency range, whereas the non-slot structure may contribute to a frequency response for the antenna in another frequency range. If desired, the frequency responses of the non-slot and slot antenna structures may reinforce one another in one or more bands. For example, a slot antenna resonance may coincide with a harmonic of a non-slot antenna structure, thereby enhancing the frequency response of the non-slot structure at this frequency. Antenna structures such as these may be fed using direct coupling (i.e., when antenna feed terminals are connected to conductive portions of the antenna) or using indirect coupling (i.e., where the antenna is excited through near-field coupling interactions).

Hybrid slot antennas may be used at one end or both ends of device 10. For example, one hybrid antenna may be used as a dual band antenna (e.g., in region 21) and one hybrid antenna may be used as a pentaband antenna (e.g., in region 18). The pentaband antenna may be used to cover wireless communications bands such as the wireless bands at 850 MHz, 900 MHz, 1800 MHz, 1900 MHz, and 2100 MHz (as an example). The dual band antenna may be used to handle 1575 MHz signals for GPS operations and 2.4 GHz signals for Bluetooth® and IEEE 802.11 operations (as an example).

Figure 2:
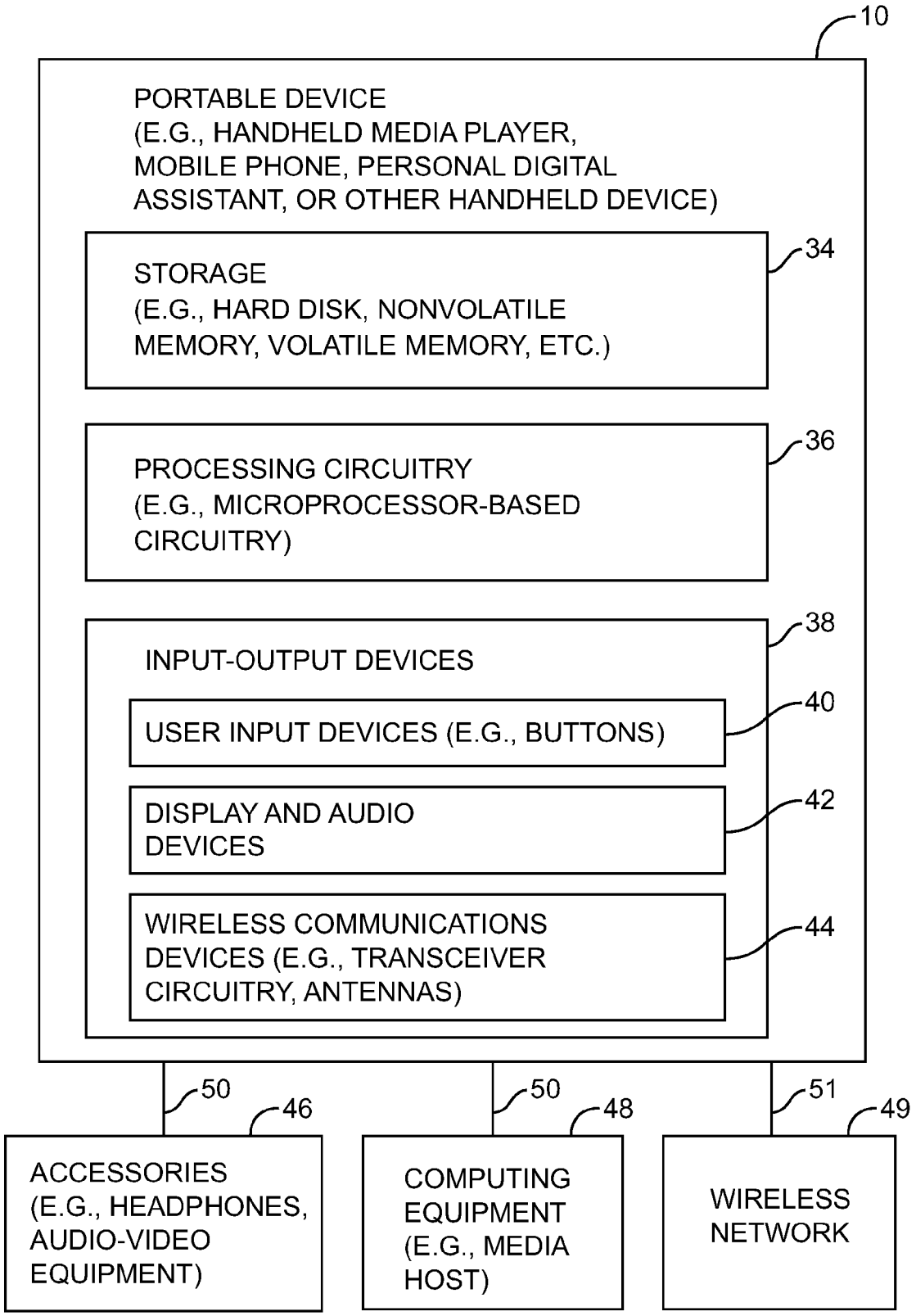
FIG. 2 is a schematic diagram of an illustrative portable electronic device in accordance with an embodiment of the present invention.

A schematic diagram of an embodiment of an illustrative portable electronic device such as a handheld electronic device is shown in FIG. 2. Portable device 10 may be a mobile telephone, a mobile telephone with media player capabilities, a handheld computer, a remote control, a game player, a global positioning system (GPS) device, a laptop computer, a tablet computer, an ultraportable computer, a hybrid device that includes the functionality of some or all of these devices, or any other suitable portable electronic device.

As shown in FIG. 2, device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G communications services (e.g., using wide band code division multiple access techniques), 2G cellular telephone communications protocols, etc.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications).

Device 10 can communicate with external devices such as accessories 46, computing equipment 48, and wireless network 49 as shown by paths 50 and 51. Paths 50 may include wired and wireless paths. Path 51 may be a wireless path. Accessories 46 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another portable electronic device 10), or any other suitable computing equipment.

Wireless network 49 may include any suitable network equipment, such as cellular telephone base stations, cellular towers, wireless data networks, computers associated with wireless networks, etc. For example, wireless network 49 may include network management equipment that monitors the wireless signal strength of the wireless handsets (cellular telephones, handheld computing devices, etc.) that are in communication with network 49.

The antenna structures and wireless communications devices of device 10 may support communications over any suitable wireless communications bands. For example, wireless communications devices 44 may be used to cover communications frequency bands such as cellular telephone voice and data bands at 850 MHz, 900 MHz, 1800 MHz, 1900 MHz, and 2100 MHz (as examples). Devices 44 may also be used to handle the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1575 MHz.

Device 10 can cover these communications bands and/or other suitable communications bands using the antenna structures in wireless communications circuitry 44. As an example, a pentaband cellular telephone antenna may be provided at one end of device 10 (e.g., in region 18) to handle 2G and 3G voice and data signals and a dual band antenna may be provided at another end of device 10 (e.g., in region 21) to handle GPS and 2.4 GHz signals. The pentaband antenna may be used to cover wireless bands at 850 MHz, 900 MHz, 1800 MHz, 1900 MHz, and 2100 MHz (as an example). These bands may be covered in groups. For example, a first communications band may be used to handle signals at 800 MHz and 900 MHz and a second communications band may be used to handle communications at 1800 MHz, 1900 MHz, and 2100 MHz. In this respect, the pentaband antenna may be considered to operate as a dual-band antenna, each band covering multiple subbands of interest. If desired, another (dual band) antenna may be used to handle 1575 MHz signals for GPS operations and 2.4 GHz signals (for Bluetooth® and IEEE 802.11 operations). These are merely illustrative arrangements. Any suitable antenna structures may be used in device 10 if desired.

To facilitate manufacturing operations, device 10 may be formed from two intermediate assemblies, representing upper and lower portions of device 10. The upper or top portion of device 10 may sometimes be referred to as a tilt assembly. The lower or bottom portion of device 10 may sometimes be referred to as a housing assembly.

The tilt and housing assemblies may each be formed from a number of smaller components. For example, the tilt assembly may be formed from components such as display 16 and an associated touch sensor. The housing assembly may include a plastic housing portion 12, bezel 14, and printed circuit boards. Integrated circuits and other components may be mounted on the printed circuit boards.

During initial manufacturing operations, the tilt assembly may be formed from its constituent parts and the housing assembly may be formed from its constituent parts. Because essentially all components in device 10 make up part of these two assemblies with this type of arrangement, the finished assemblies represent a nearly complete version of device 10. The finished assemblies may, if desired, be tested. If testing reveals a defect, repairs may be made or defective assemblies may be discarded. During a final set of manufacturing operations, the tilt assembly is inserted into the housing assembly. With one suitable arrangement, one end of the tilt assembly is inserted into the housing assembly. The tilt assembly is then rotated ("tilted") into place so that the upper surface of the tilt assembly lies flush with the upper edges of the housing assembly.

As the tilt assembly is rotated into place within the housing assembly, clips on the tilt assembly engage springs on the housing assembly. The clips and springs form a detent that helps to align the tilt assembly properly with the housing assembly. Should rework or repair be necessary, the insertion process can be reversed by rotating the tilt assembly up and away from the housing assembly. During rotation of the tilt assembly relative to the housing assembly, the springs flex to accommodate movement. When the tilt assembly is located within the housing assembly, the springs press into holes in the clips to prevent relative movement between the tilt and housing assemblies. Rework and repair operations need not be destructive to the springs, clips, and other components in the device. This helps to prevent waste and complications that might otherwise interfere with the manufacturing of device 10.

If desired, screws or other fasteners may be used to help secure the tilt assembly to the housing assembly. The screws may be inserted into the lower end of device 10. With one suitable arrangement, the screws are inserted in an unobtrusive portion of the end of device 10 so that they are not noticeable following final assembly operations. Prior to rework or repair operations, the screws can be removed from device 10.

Figure 3:
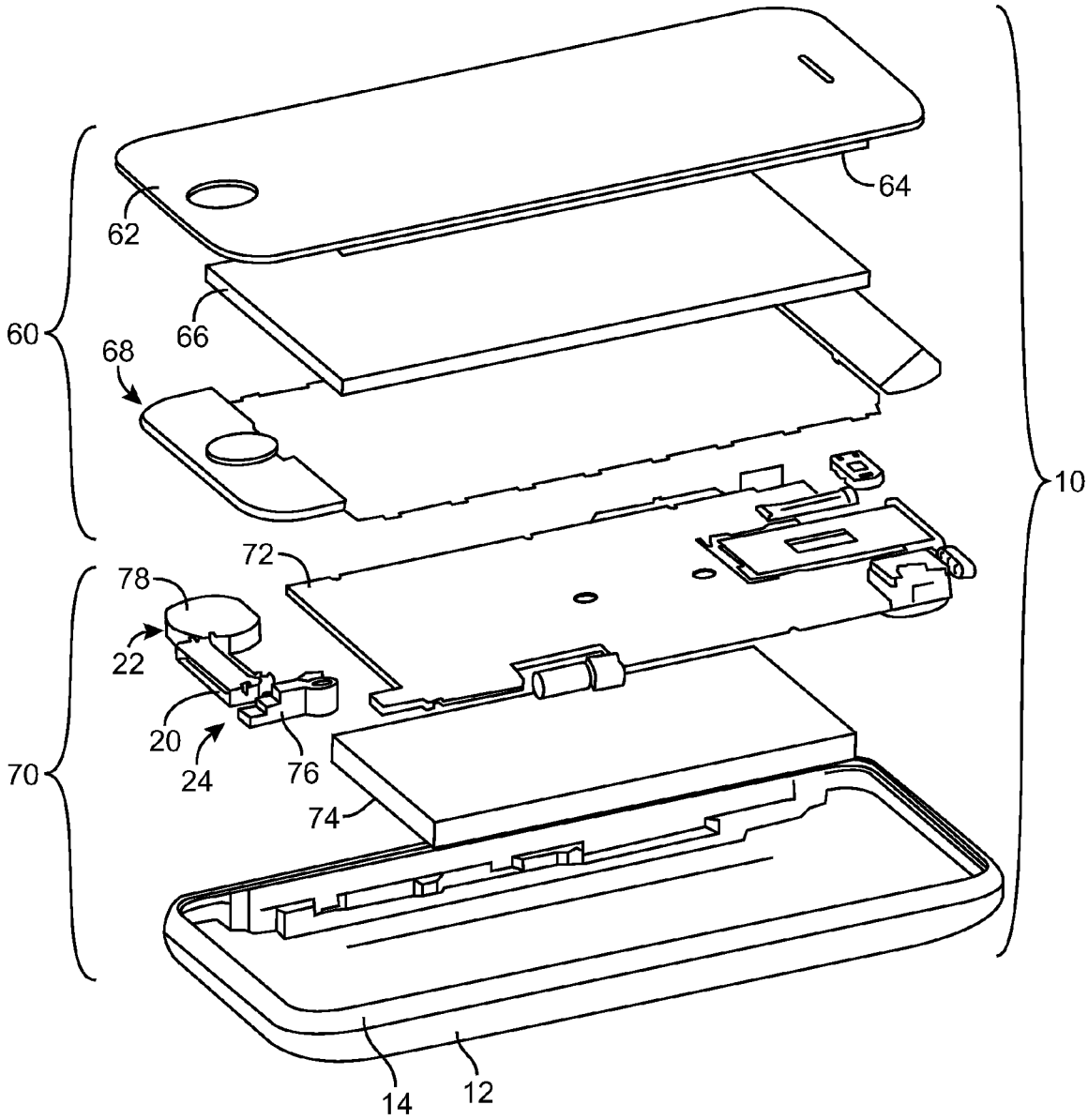
FIG. 3 is an exploded perspective view of an illustrative portable electronic device in accordance with an embodiment of the present invention.

An exploded perspective view showing illustrative components of device 10 is shown in FIG. 3.

Tilt assembly 60 (shown in its unassembled state in FIG. 3) may include components such as cover 62, touch sensitive sensor 64 (e.g., a capacitive multitouch sensor), display unit 66, and frame 68. Cover 62 may be formed of glass or other suitable transparent materials (e.g., plastic, combinations of one or more glasses and one or more plastics, etc.). Display unit 66 may be, for example, a color liquid crystal display. Frame 68 may be formed from one or more pieces. With one suitable arrangement, frame 68 may include metal pieces to which plastic parts are connected using an overmolding process. If desired, frame 68 may be formed entirely from plastic or entirely from metal.

Housing assembly 70 (shown in its unassembled state in FIG. 3) may include housing 12. Housing 12 may be formed of plastic and/or other materials such as metal (metal alloys). For example, housing 12 may be formed of plastic to which metal members are mounted using fasteners, a plastic overmolding process, or other suitable mounting arrangement.

As shown in FIG. 3, handheld electronic device 10 may have a bezel such as bezel 14. Bezel 14 may be formed of plastic or other dielectric materials or may be formed from metal or other conductive materials. An advantage of a metal (metal alloy) bezel is that materials such as metal may provide bezel 14 with an attractive appearance and may be durable. If desired, bezel 14 may be formed from shiny plastic or plastic coated with shiny materials such as metal films.

Bezel 14 may be mounted to housing 12. Following final assembly, bezel 14 may surround the display of device 10 and may, if desired, help secure the display onto device 10. Bezel 14 may also serve as a cosmetic trim member that provides an attractive finished appearance to device 10.

Housing assembly 70 may include battery 74. Battery 74 may be, for example, a lithium polymer battery having a capacity of about 1300 ma-hours. Battery 74 may have spring contacts that allow battery 74 to be serviced.

Housing assembly 70 may also include one or more printed circuit boards such as printed circuit board 72. Components may be mounted to printed circuit boards such as microphone 76 for microphone port 24, speaker 78 for speaker port 22, and dock connector 20, integrated circuits, a camera, ear speaker, audio jack, buttons, SIM card slot, etc.

Figure 4:
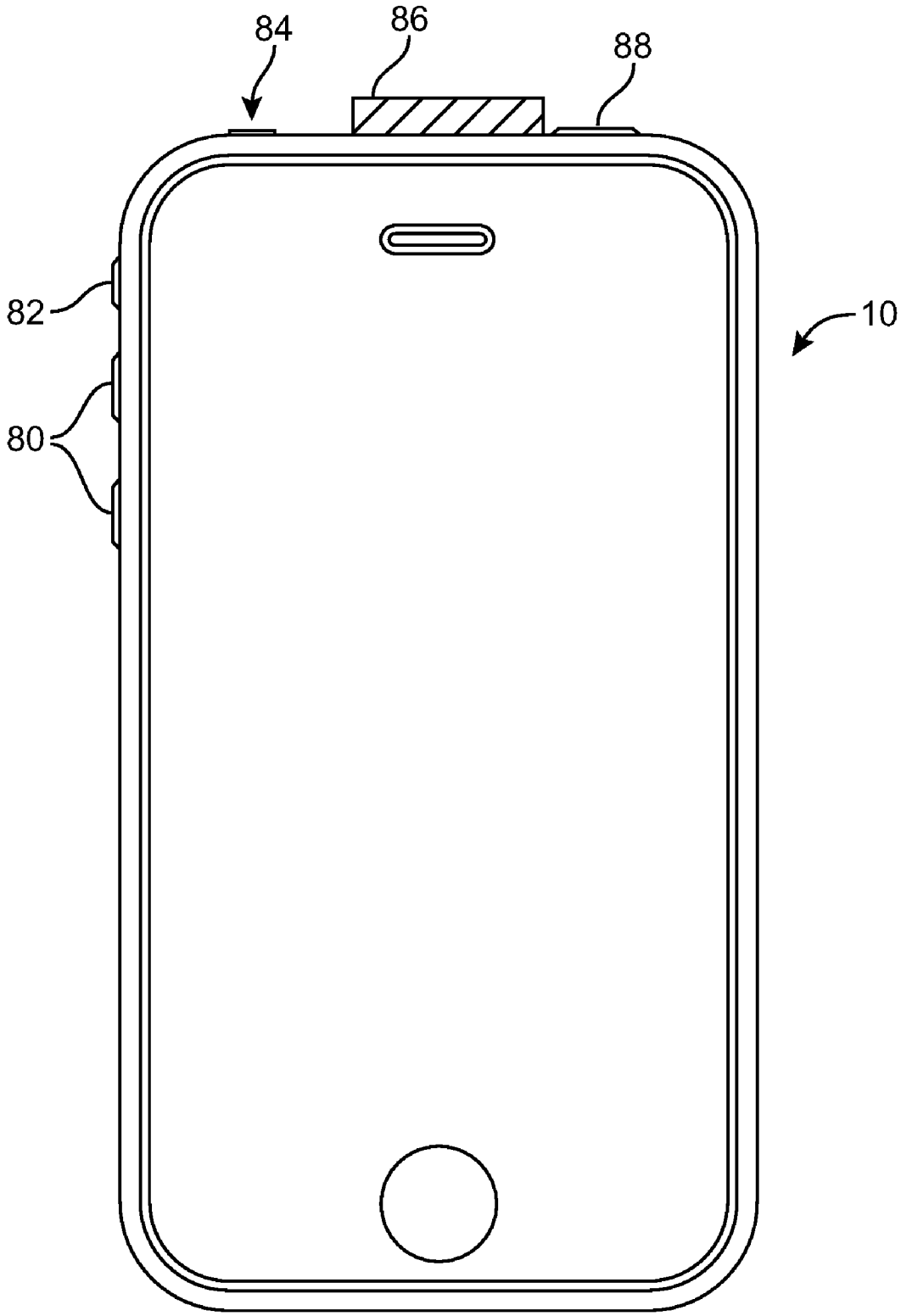
FIG. 4 is a top view of an illustrative portable electronic device in accordance with an embodiment of the present invention.

A top view of an illustrative device 10 is shown in FIG. 4. As shown in FIG. 4, device 10 may have controller buttons such as volume up and down buttons 80, a ringer A/B switch 82 (to switch device 10 between ring and vibrate modes), and a hold button 88 (sleep/wake button). A subscriber identity module (SIM) tray 86 (shown in a partially extended state) may be used to receive a SIM card for authorizing cellular telephone services. Audio jack 84 may be used for attaching audio peripherals to device 10 such as headphone, a headset, etc.

Figure 5:
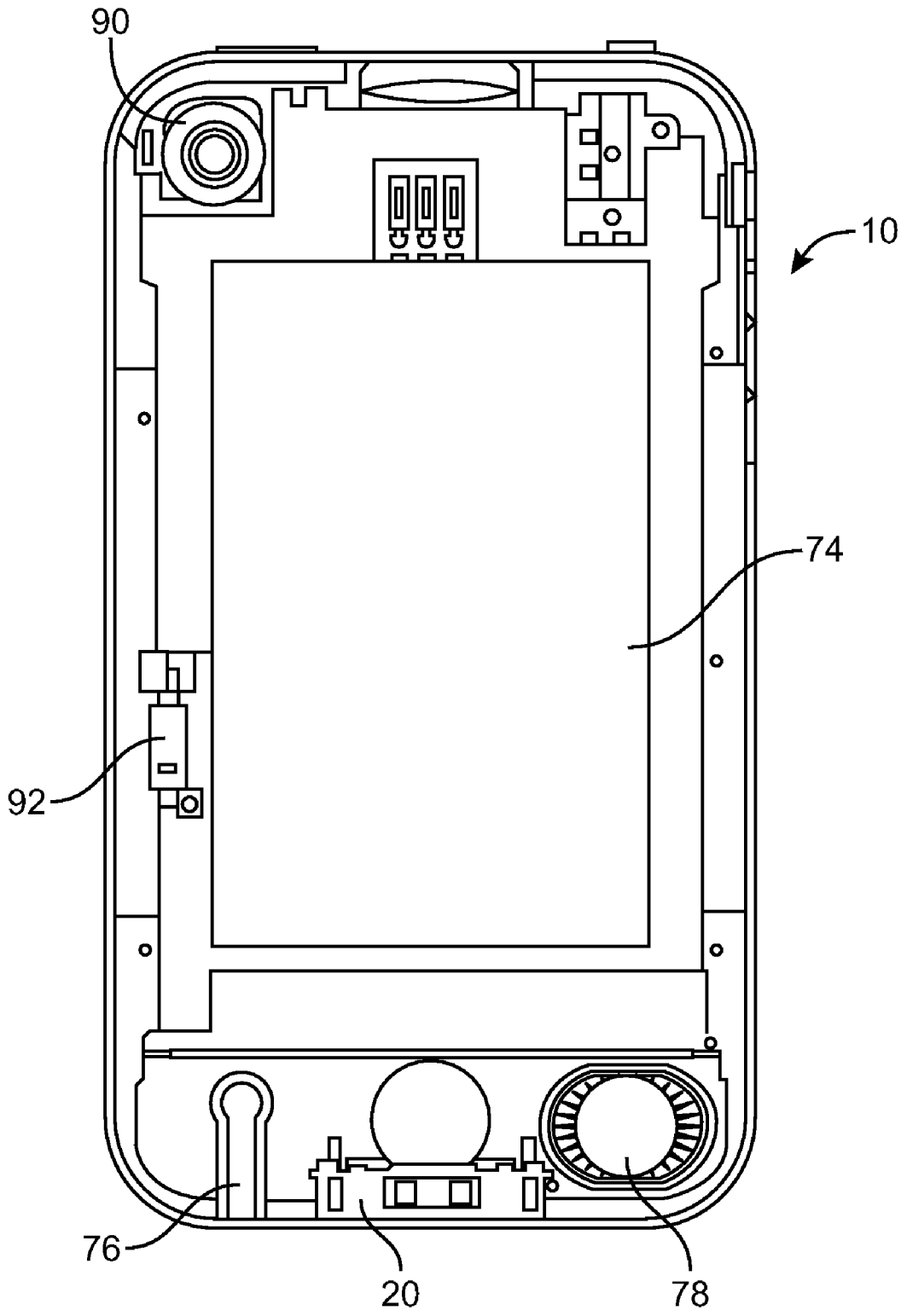
FIG. 5 is an interior bottom view of an illustrative portable electronic device in accordance with an embodiment of the present invention.

An interior bottom view of device 10 is shown in FIG. 5. As shown in FIG. 5, device 10 may have a camera 90. Camera 90 may be, for example, a two megapixel fixed focus camera.

Vibrator 92 may be used to vibrate device 10. Device 10 may be vibrated at any suitable time. For example, device 10 may be vibrated to alert a user to the presence of an incoming telephone call, an incoming email message, a calendar reminder, a clock alarm, etc.

Battery 74 may be a removable battery that is installed in the interior of device 10 adjacent to dock connector 20, microphone 76, and speaker 78.

Figure 6:
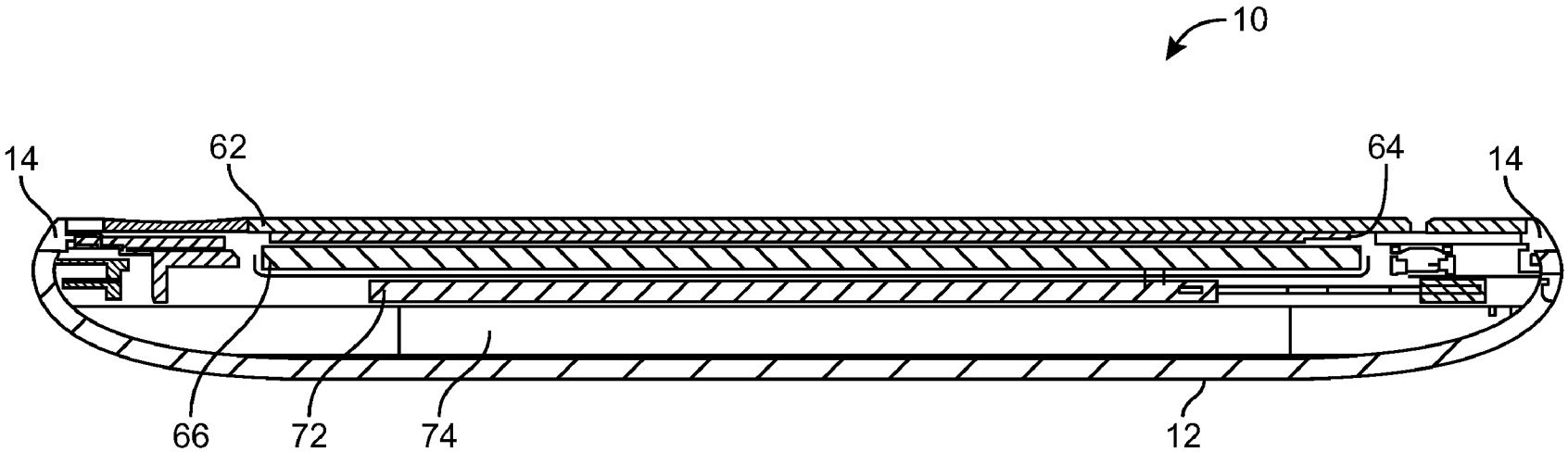
FIG. 6 is a side view of an illustrative portable electronic device in accordance with an embodiment of the present invention.

A cross-sectional side view of device 10 is shown in FIG. 6. FIG. 6 shows the relative vertical positions of device components such as housing 12, battery 74, printed circuit board 72, liquid crystal display unit 66, touch sensor 64, and cover glass 62 within device 10. FIG. 6 also shows how bezel 14 may surround the top edge of device 10 (e.g., around the portion of device 10 that contains the components of display 16 such as cover 62, touch screen 64, and display unit 66). Bezel 14 may be a separate component or, if desired, one or more bezel-shaped structures may be formed as integral parts of housing 12 or other device structures.

Figure 7:
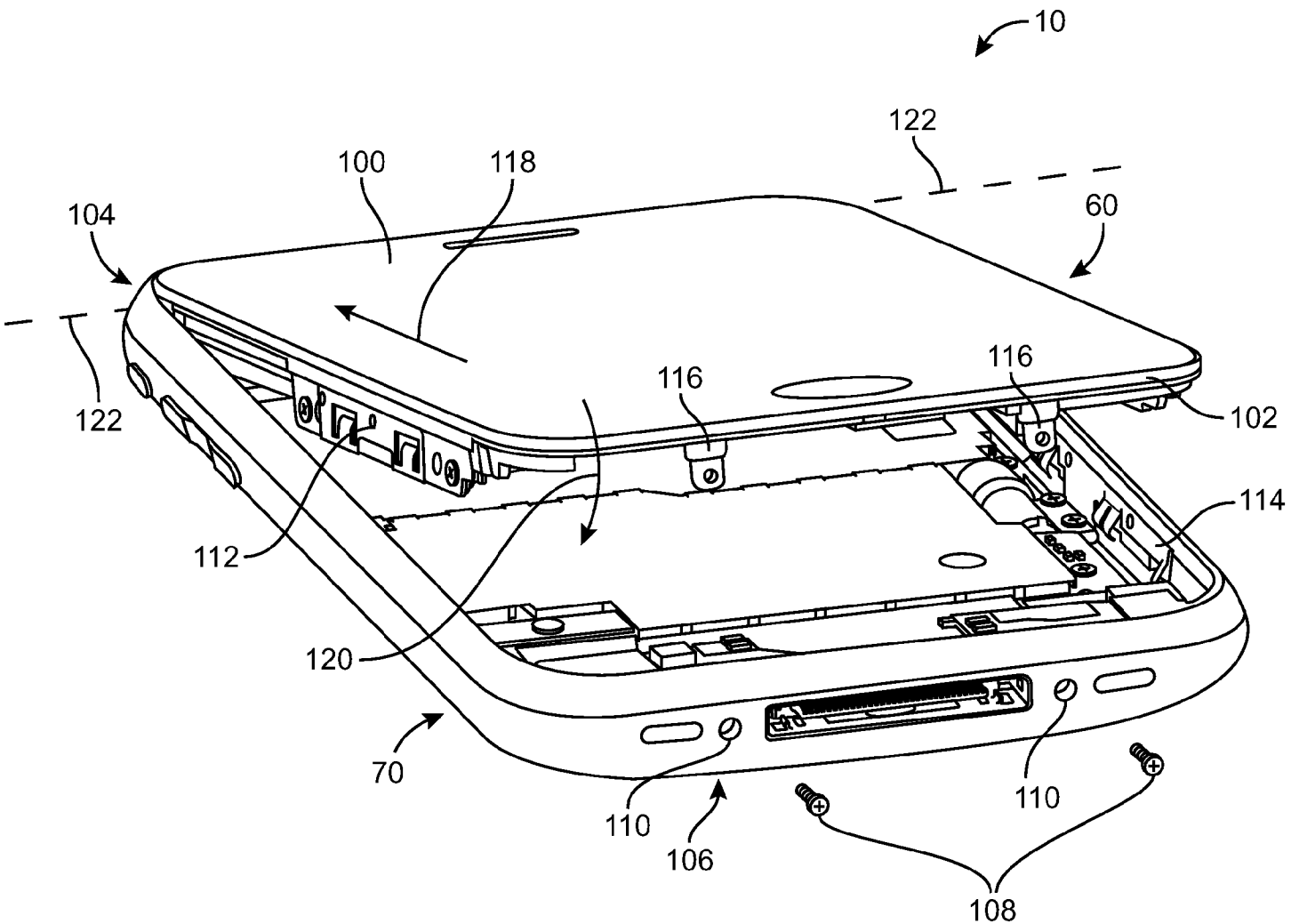
FIG. 7 is a perspective view of a partially assembled portable electronic device in accordance with an embodiment of the present invention showing how an upper portion of the device may be inserted into a lower portion of the device.

Device 10 may be assembled from tilt assembly 60 and housing assembly 70. As shown in FIG. 7, the assembly process may involve inserting upper end 100 of tilt assembly 60 into upper end 104 of housing assembly 70 along direction 118 until protrusions on the upper end of tilt assembly 60 engage mating holes on housing assembly 70. Once the protrusions on tilt assembly 60 have engaged with housing assembly 70, lower end 102 of tilt assembly 60 may be inserted into lower end 106 of housing assembly 70. Lower end 102 may be inserted into lower end 106 by pivoting tilt assembly 60 about pivot axis 122. This causes tilt assembly 60 to rotate into place as indicated by arrow 120.

Tilt assembly 60 may have clips such as clips 112 and housing assembly 70 may have matching springs 114. When tilt assembly 60 is rotated into place within housing assembly 70, the springs and clips mate with each other to hold tilt assembly 60 in place within housing assembly 70.

Tilt assembly 60 may have one or more retention clips such as retention clips 116. Retention clips 116 may have threaded holes that mate with screws 108. After tilt assembly has been inserted into housing assembly, screws 108 may be screwed into retention clips 116 through holes 110 in housing assembly 70. This helps to firmly secure tilt assembly 60 to housing assembly 70. Should rework or repair be desired, screws 108 may be removed from retention clips 116 and tilt assembly 60 may be released from housing assembly 70. During the removal of tilt assembly 60 from housing assembly 70, springs 114 may flex relative to clips 112 without permanently deforming. Because no damage is done to tilt assembly 60 or housing assembly 70 in this type of scenario, nondestructive rework and repair operations are possible.

Figure 8:
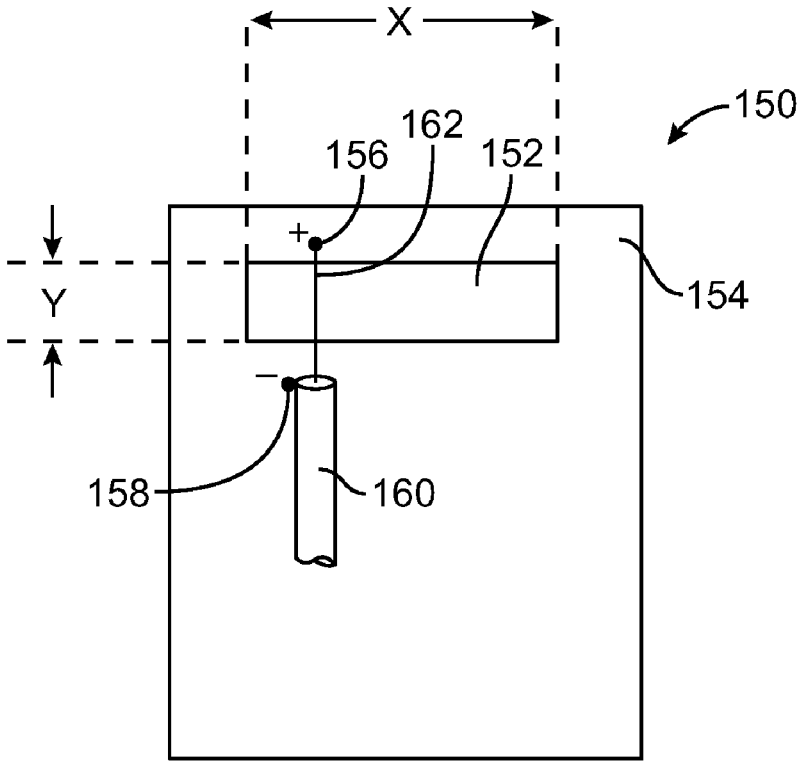
FIG. 8 is a top view of an illustrative slot antenna structure in accordance with an embodiment of the present invention.

Device 10 may have a hybrid antenna that has the attributes of both a slot antenna and a non-slot antenna such as a planar inverted-F antenna. A top view of a slot antenna structure 150 is shown in FIG. 8. Slot 152 may be formed within ground plane 154. In device 10, ground plane 154 may be formed by conductive components such as display 16, printed circuit board conductors, components, etc. Slot 152 may be filled with a dielectric. For example, portions of slot 152 may be filled with air and portions of slot 152 may be filled with solid dielectrics such as plastic. A coaxial cable 160 or other transmission line path may be used to feed antenna structure 150. In the example of FIG. 8, antenna structure 150 is being fed so that the center conductor 162 of coaxial cable 160 is connected to signal terminal 156 (i.e., the positive or feed terminal of antenna structure 150) and the outer braid of coaxial cable 160, which forms the ground conductor for cable 160, is connected to ground terminal 158.

Figure 9:
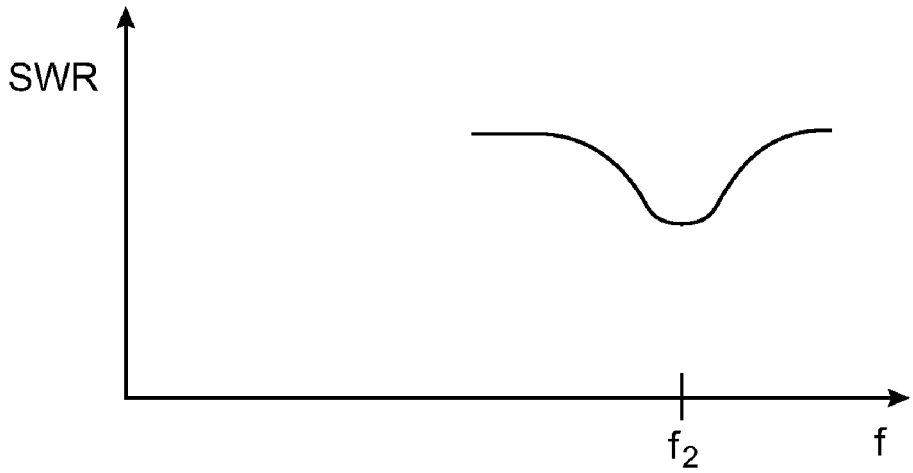
FIG. 9 is an illustrative graph showing antenna performance as a function of frequency for an illustrative slot antenna structure of the type shown in FIG. 8 in accordance with an embodiment of the present invention.

The performance of a slot antenna structure such as antenna structure 150 of FIG. 8 may be characterized by a graph such as the graph of FIG. 9. As shown in FIG. 9, slot antenna structure 150 operates in a frequency band that is centered about center frequency $f_2$. The center frequency $f_2$ may be determined by the dimensions of slot 152. In the illustrative example of FIG. 8, slot 152 has an inner perimeter P that is equal to two times dimension X plus two times dimension Y (i.e., P=2X+2Y). (In general, the perimeter of slot 152 may be irregular.) At center frequency $f_2$, perimeter P is equal to one wavelength. The position of terminals 158 and 156 may be selected to help match the impedance of antenna structure 150 to the impedance of transmission line 160. If desired, terminals such as terminals 156 and 158 may be located at other positions about slot 152. In the illustrative arrangement of FIG. 8, terminals 156 and 158 are shown as being respectively configured as a slot antenna signal terminal and a slot antenna ground terminal, as an example. If desired, terminal 156 could be used as a ground terminal and terminal 158 could be used as a signal terminal.

In forming a hybrid antenna for device 10, a slot antenna structure such as slot antenna structure 150 of FIG. 8 may be used in conjunction with an additional antenna structure such as a planar inverted-F antenna structure. An illustrative planar inverted-F antenna structure is shown in FIG. 10.

Figure 10:
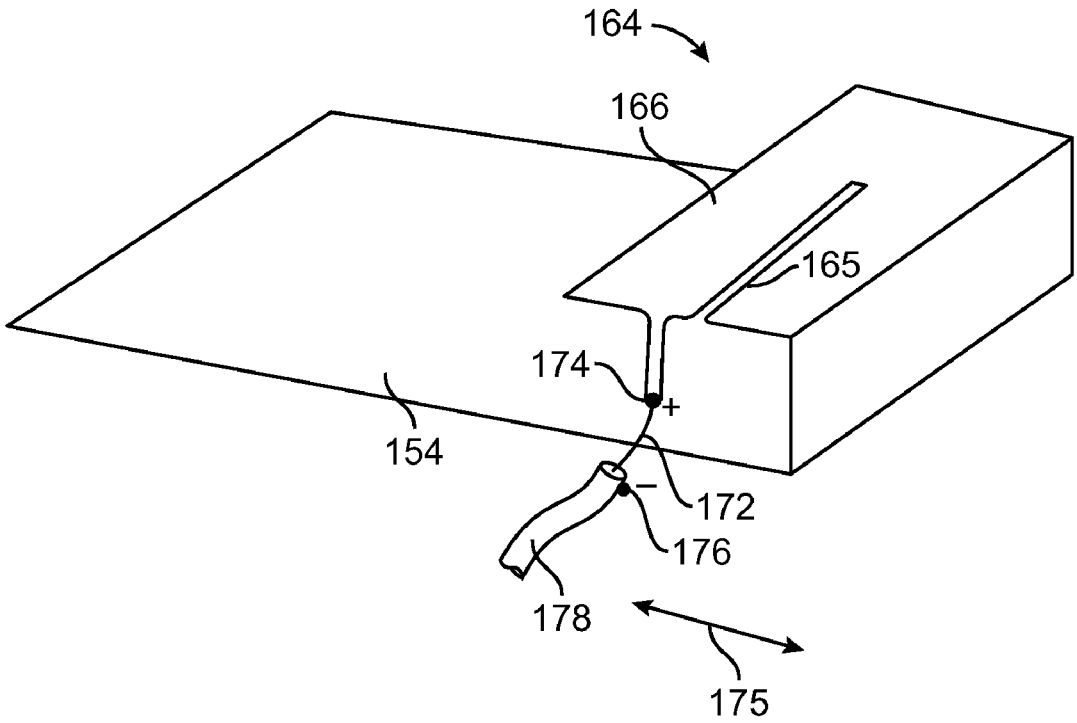
FIG. 10 is a perspective view of an illustrative planar inverted-F antenna structure in accordance with an embodiment of the present invention.

As shown in FIG. 10, planar inverted-F antenna structure 164 may have a substantially planar resonating element 166 that lies in a plane above ground plane 154. Element 166 may have a groove such as groove 165 or other features that change the shape of element 166. For example, element 166 may have one or more arms, rather than the single folded arm structure shown in the example of FIG. 10. Planar inverted-F antenna resonating element 166 may be fed by a transmission line such as coaxial cable 178. In the example of FIG. 10, antenna structure 164 is being fed so that center conductor 172 of coaxial cable 178 is connected to signal terminal 174 (i.e., the positive feed terminal of antenna structure 164) and so that the outer braid of coaxial cable 178, which forms the ground conductor for cable 178, is connected to antenna ground terminal 176. The position of the feed point for antenna structure 164 along the resonating element arm 166 in dimension 175 may be selected for impedance matching between antenna structure 164 and transmission line 178.

Figure 11:
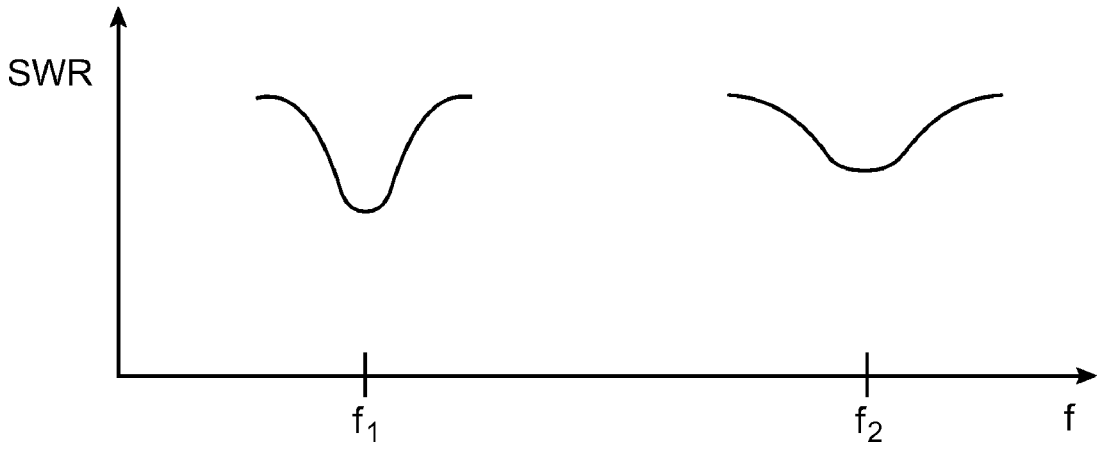
FIG. 11 is an illustrative graph showing antenna performance as a function of frequency for an illustrative planar inverted-F antenna structure of the type shown in FIG. 10 in accordance with an embodiment of the present invention.

The performance of an antenna structure such as planar inverted-F antenna structure 164 of FIG. 10 may be characterized by a graph such as the graph of FIG. 11. As shown in FIG. 11, antenna structure 164 may operate in a frequency band that is centered about center frequency $f_1$. The center frequency $f_1$ may be determined by the dimensions of antenna resonating element 166 (e.g., the overall length of bent arm 166 may be approximately a quarter of a wavelength). Frequency $f_2$, at which planar inverted-F antenna structure 164 may provide additional antenna coverage, may coincide with a harmonic of frequency $f_1$ (as an example).

Figure 12:
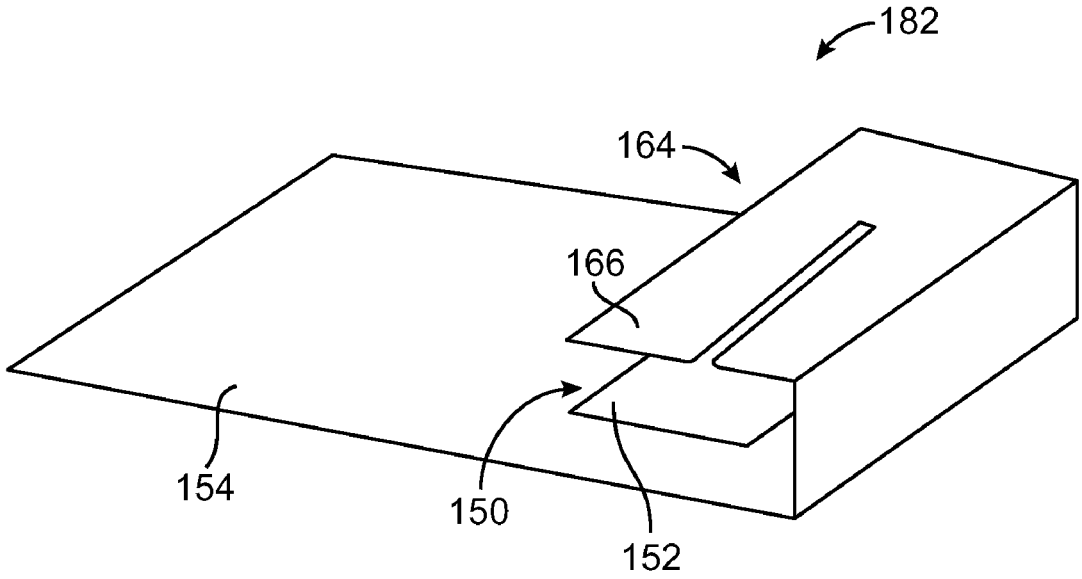
FIG. 12 is a perspective view of an illustrative hybrid planar-inverted-F-slot antenna in accordance with an embodiment of the present invention.

A hybrid antenna may be formed by combining a slot antenna structure of the type shown in FIG. 8 with an inverted-F antenna structure of the type shown in FIG. 10. This type of arrangement is shown in FIG. 12. As shown in FIG. 12, antenna 182 may include an inverted-F antenna structure 164 and a slot antenna structure 150. Slot antenna structure 150 may be formed from a slot in ground plane 154 such as slot 152. Ground plane 154 may be formed by conductive housing members, printed circuit boards, bezel 14, electrical components, etc. Slot 152 of FIG. 12 is shown as being rectangular, but in general, slot 152 may have any suitable shape (e.g., an elongated irregular shape determined by the sizes and shape of conductive structures in device 10). Planar inverted-F antenna structure 164 may have an arm such as arm 166. Arms such as arm 166 may have one or more bends, extensions, or other shapes, if desired. Multiarm structures may also be used.

Transceiver circuitry may be coupled to antenna 182 using one or more transmission line structures. Examples of suitable transmission lines that may be used for feeding antenna 182 include coaxial cables, flex circuit microstrip transmission lines, microstrip transmission lines on printed circuit boards, etc.

Figure 13:
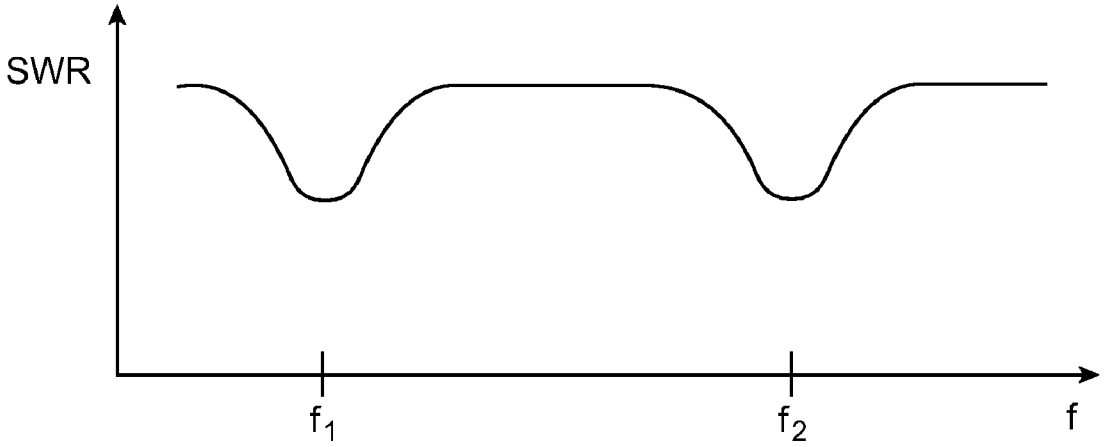
FIG. 13 is a graph showing antenna performance for a hybrid antenna of the type shown in FIG. 12 in accordance with the present invention.

Hybrid antennas such as hybrid antenna 182 of FIG. 12 may cover multiple communications bands. As shown in FIG. 13, for example, the sizes of slot 152 and planar inverted-F antenna resonating element structure 166 may be chosen so that planar inverted-F structure 168 resonates at a first frequency $f_1$ and has a harmonic resonance at frequency $f_2$, while slot antenna structure 150 provides an additional frequency response at second frequency $f_2$, which increases the efficiency of antenna 182 at frequency $f_2$. The resonance at frequency $f_1$ may cover communications bands at 800 MHz and 900 MHz and the resonance at frequency $f_2$ may cover communications bands at 1800 MHz, 1900 MHz, and 2100 MHz (as examples). With this type of arrangement, hybrid antenna 182 may be referred to as a dual band antenna (i.e., an antenna with resonances at a first frequency $f_1$ and a second frequency f2) or may be referred to as a pentaband antenna (i.e., an antenna that covers bands at 800 MHz, 900 MHz, 1800 MHz, 1900 MHz, and 2100 MHz).

Figure 14:
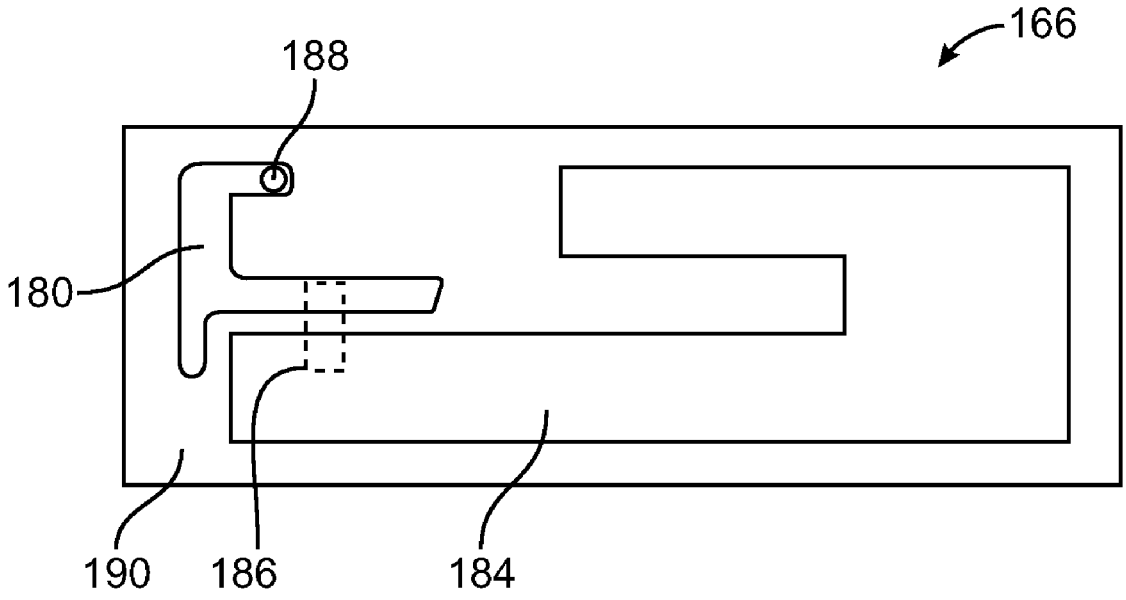
FIG. 14 is a top view of an illustrative planar-inverted-F antenna resonating element in accordance with an embodiment of the present invention.

FIG. 14 shows a top view of an illustrative planar-inverted-F resonating element 166. Antenna resonating element 166 may be a substantially single-arm resonating element structure formed from conductive portions such as conductive portion 180 and 184. Conductive portions 180 and 184 may be formed from conductive traces such as conductive copper traces or traces formed from other suitable metals. Traces such as traces 180 and 184 may be formed on a flex circuit substrate such as flex circuit substrate 190 or any other suitable support structure. A typical flex circuit substrate material is polyimide. Element 166 may also be formed using other structures (e.g., stamped metal foils, etc.). In the illustrative arrangement of FIG. 14, a series capacitance is formed between elements 180 and 184 from overlaps created by backside conductive trace 186. In general, a hybrid antenna in device 10 may use any suitable electrical components (e.g., capacitors, inductors, and resistors) in any suitable configuration (series, parallel) to form an impedance matching network and/or frequency tuning network for the antenna.

Figure 15:
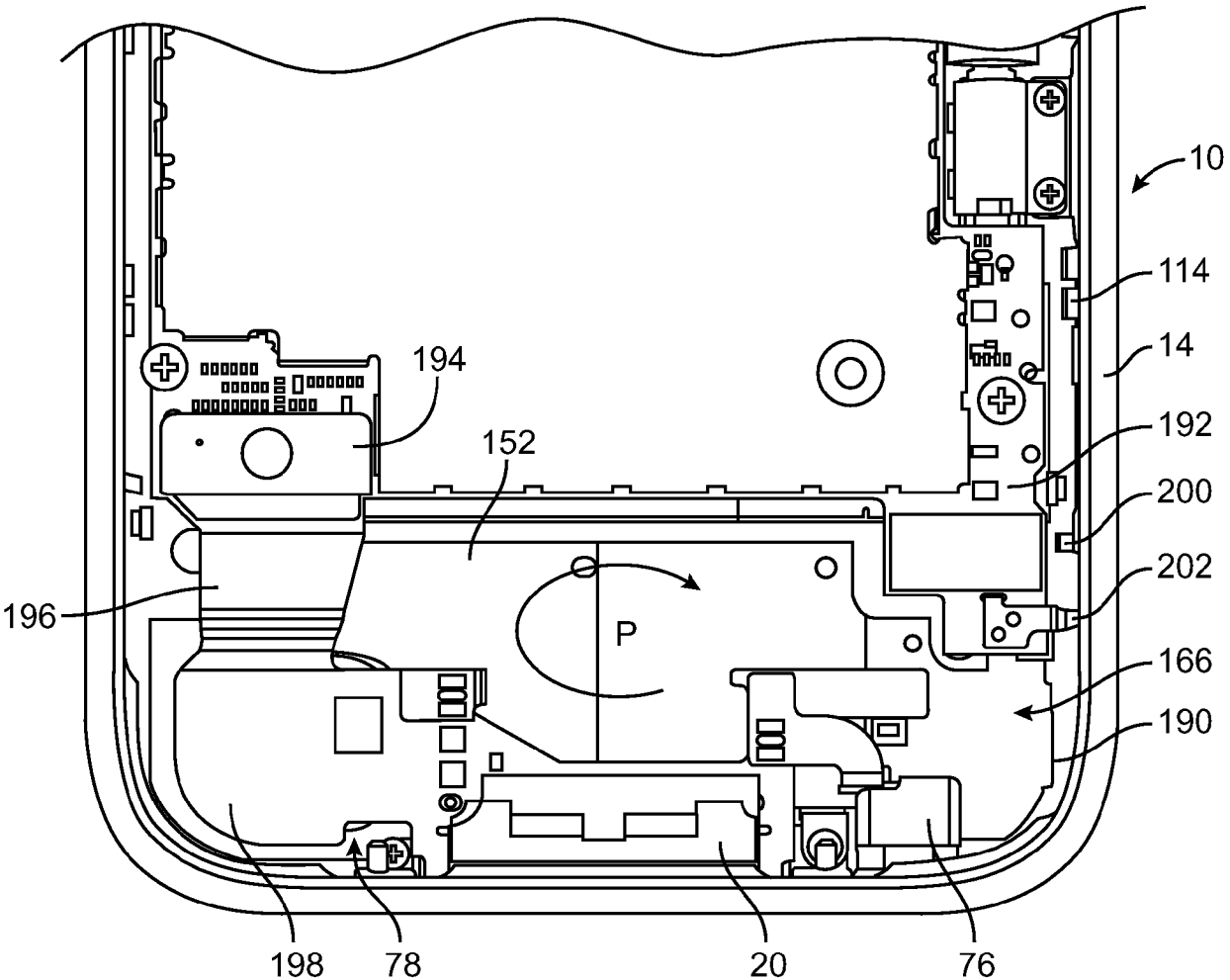
FIG. 15 is a top view of an illustrative handheld electronic device with a hybrid antenna structure in accordance with an embodiment of the present invention.

The shape of slot 152 in the hybrid antenna may be determined by the shapes and locations of conductive structures in device 10 such as electrical components, flex circuit structures used for interconnecting electrical components, printed circuit board conductors, metal housing structures, metal brackets, bezel 14, etc. This is illustrated in the top view of FIG. 15. As shown in FIG. 15, slot 152 may have an inner perimeter P that is defined along its left, right, and lower sides by bezel 14 and dock connector flex circuit 198 and along its upper side by printed circuit board 192 (and conductive elements such as frame midplate 208 of FIG. 16). The conductive structures surrounding slot 152 (e.g., metal structures, electrical components, flex circuits, etc.) intrude on the generally rectangular slot shape formed between bezel 14 and printed circuit board 192 and thereby modify the location and length of perimeter P.

Planar inverted-F antenna structure 166 may be positioned so that structure 166 and substrate 190 overlap slot 152 (as shown schematically in FIG. 12). Dock connector flex circuit 198 may contain conductive traces that carry signals between 30-pin dock connector 20 and circuitry on printed circuit board 192. Conductive foam pad 196 may be used to ground dock connector flex circuit 198 to a conductive midplate structure associated with tilt assembly 60 (not shown in FIG.

Figure 16:
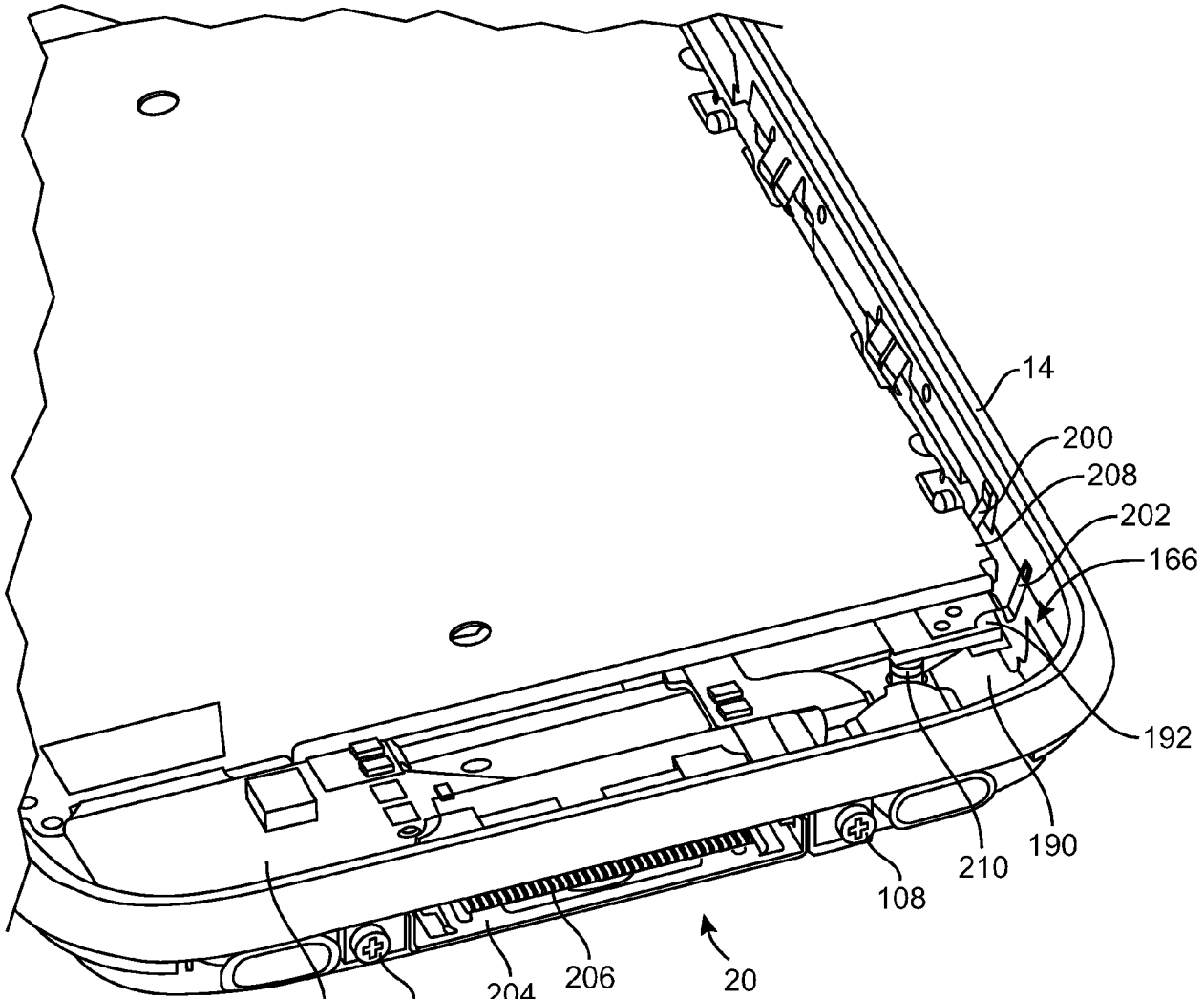
FIG. 16 is a perspective view of a portion of a handheld electronic device showing how grounding spring structures may be used to ground a printed circuit board to a conductive bezel when forming an antenna slot structure for a hybrid antenna in accordance with an embodiment of the present invention.

15, but shown as midplate 208 in FIG. 16). Board-to-board connector 194 may be used to electrically connect the conductive traces in dock connector flex circuit 198 to the circuitry of board 192.

The antenna may be fed using a spring-loaded pin sometimes referred to as a pogo pin. The pogo pin may serve as a positive antenna feed terminal and may be connected to the traces in planar inverted-F antenna resonating element 166 by bearing against a portion of these conductive regions at feed location 188 (FIG. 14). Electrical connecting structures such as springs may be used to form electrical connections with conductive bezel 14 (or other such conductive structures).

Spring 200 may be used to form an electrical connection between bezel 14 and midplate 208 (FIG. 16). Spring 200 may be formed as part of a metal rail. The metal rail may also be used to form springs such as springs 114 for engaging with clips 112 when assembling tilt assembly 60 and housing assembly 70. The metal rail may be electrically and mechanically connected to bezel 14 using any suitable arrangement. For example, the metal rail and spring 200 may be welded to bezel 14.

Spring 202 may be used to form an electrical connection between ground conductors on printed circuit board 192 (i.e., a printed circuit board ground that is tied to antenna transmission line ground) and bezel 14. As such, spring 202 may be considered to form an antenna ground terminal for the antenna feed (i.e., a ground terminal such as ground 158 of FIG. 8).

If desired, isolation components may be used to electrically isolate electrical components that overlap slot 152 at the frequencies at which antenna 182 operates. For example, series-connected inductors may be used to electrically isolate microphone components in microphone 76 from slot 152 at radio frequencies. Other components may also be isolated if desired (e.g., speaker 78, buttons, etc.).

A perspective view of the end of device 10 is shown in FIG. 16. As shown in FIG. 16, spring 202 may be part of a larger bracket-shaped conductor that is mounted to printed circuit board 192. Pogo pin 210 may be used as a positive signal terminal that forms an electrical connection between a radio-frequency positive signal path in a transmission line structure on board 192 and the planar inverted-F antenna resonating element. The transmission line structure may be used to interconnect the hybrid antenna to radio-frequency transceiver circuitry on the printed circuit board.

Dock connector 20 may have a conductive frame 204 (e.g., a metal frame), and pins 206. Pins 206 may be electrically connected to corresponding traces in dock connector flex circuit 198.

Midplate 208 may be formed from metal and may form part of tilt assembly 60. Midplate 208 may be used to provide structural support for components such as display 16 in tilt assembly 60. With one suitable arrangement, midplate 208 may be formed from a conductive material such as metal. Spring 200 may be used to electrically connect (ground) midplate 208 to bezel 14.

Figure 17:
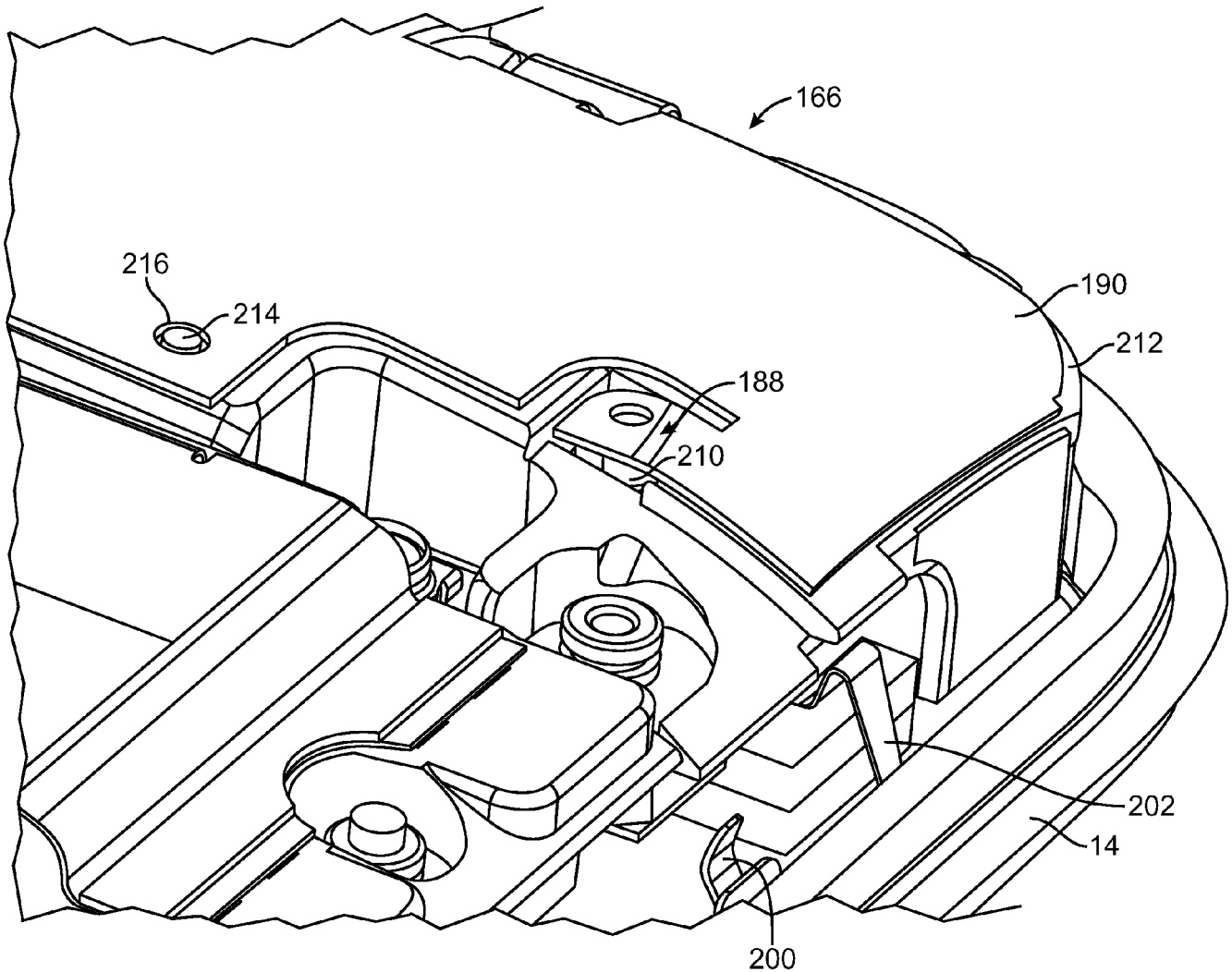
FIGS. 17 and 18 are perspective views of a portion of a handheld electronic device in which a spring-loaded pin has been used to create an antenna contact to a flex circuit antenna resonating element in accordance with an embodiment of the present invention.

FIG. 17 shows the end of device 10 in the vicinity of pogo pin 210. The perspective of FIG. 17 is inverted with respect to that of FIG. 16 (i.e., the interior of device 10 is being viewed from its rear in FIG. 17, whereas the interior of device 10 is being viewed from its front in FIG. 16).

As shown in FIG. 17, pogo pin 210 may be used to form an electrical contact at location 188 with the conductive structures in flex circuit 190 (i.e., trace 180 of structure 166 of FIG. 14). Antenna flex circuit 190 may be mounted to a support structure such as support structure 212. Structure 212 may be, for example, a plastic structure that also serves as an enclosure for speaker 78. Antenna flex circuit 190 may be mounted to support 212 using a layer of pressure-sensitive adhesive (as an example). To facilitate proper alignment of flex circuit 190 relative to support 212 and device 10, antenna flex circuit 190 may be provided with one or more alignment holes such as alignment hole 216. Support structure 212 may be provided with matching pegs such as peg 214.

Figure 18:
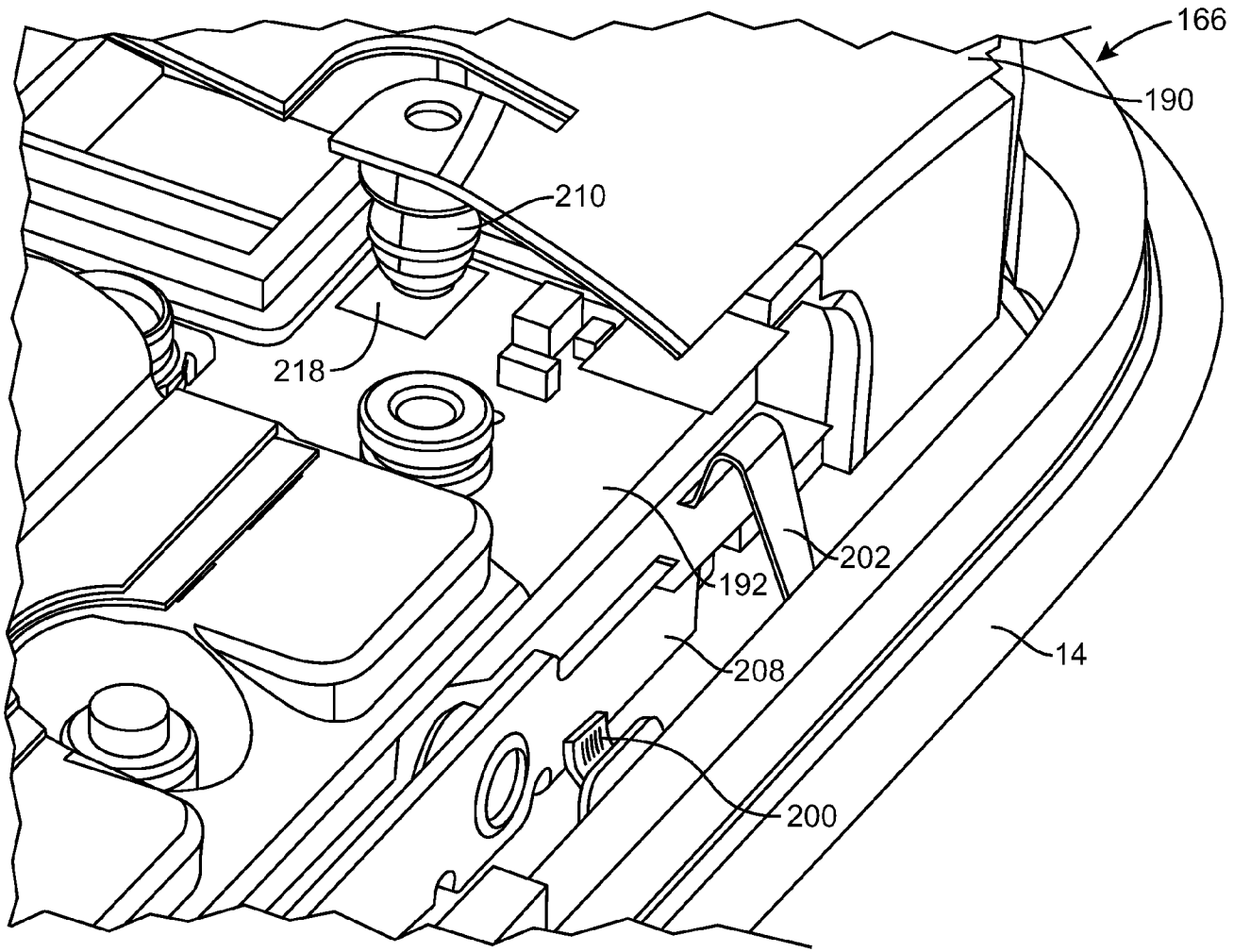

Pogo pin 210 may contain metal structures that are biased apart using an internal metal spring. When installed in device 10, the ends of pogo pin 210 may be biased away from each other to form a good electrical connection between the antenna transmission line (positive conductor) on printed circuit board 192 and the antenna resonating element conductors within flex circuit 190. As shown in FIG. 18, pogo pin 210 may be fastened to flex circuit 190 and may have an opposing end that bears against a conductive pad such as pad 218 that is formed on printed circuit board 192. In the event of rework or repair, this type of arrangement allows flex circuit 190 and therefore planar inverted-F antenna resonating element 166 to be removed from device 10 without damaging printed circuit board 192.

The antenna transmission line on printed circuit board 192 forms a pathway between the antenna and radio-frequency transceiver circuitry mounted on printed circuit board. The antenna transmission line may include a positive conductor and a ground conductor. The positive conductor may be connected to pad 218 and, via pin 210, may be connected to the antenna resonating element traces in flex circuit substrate 190. The ground conductor may be connected to ground (bezel 14) via spring 202. Grounding between midplate 208 and bezel 14 may be provided using spring 200.

The foregoing is merely illustrative of the principles of this invention and various modifications can be made by those skilled in the art without departing from the scope and spirit of the invention.

What is claimed is:

1. A portable electronic device, comprising:

a printed circuit board having a conductive region;

a flex circuit antenna resonating element having conductive traces on a flexible substrate; and a pin that electrically connects the conductive region on the printed circuit board to the flex circuit antenna resonating element.

2. The portable electronic device defined in claim 1 wherein the pin comprises a spring-loaded pin.

3. The portable electronic device defined in claim 1 further comprising:

a conductive bezel; and a spring that electrically connects the printed circuit board to the conductive bezel.

4. The portable electronic device defined in claim 1 further comprising an antenna slot having an inner perimeter defined at least partly by the conductive bezel.

5. A portable electronic device, comprising:

a printed circuit board having a conductive region;

a flex circuit antenna resonating element;

a pin that electrically connects the conductive region on the printed circuit board to the flex circuit antenna resonating element; and an antenna slot having an inner perimeter defined at least partly by the conductive bezel, wherein the flex circuit antenna resonating element forms a first portion of a hybrid antenna for the portable electronic device and resonates in a first frequency band and wherein the antenna slot forms a second portion of the hybrid antenna and resonates in a second frequency band.

6. The portable electronic device defined in claim 5 wherein the first frequency band covers communications bands at 800 MHz and 900 MHz, and wherein the second frequency band covers communications bands at 1800 MHz, 1900 MHz, and 2100 MHz.

7. The portable electronic device defined in claim 5 wherein the first frequency band covers communications bands at 800 MHz and 900 MHz.

8. The portable electronic device defined in claim 5 wherein the second frequency band covers communications bands at 1800 MHz, 1900 MHz, and 2100 MHz.

9. A portable electronic device, comprising:

a printed circuit board having a conductive region;

a flex circuit antenna resonating element; and a pin that electrically connects the conductive region on the printed circuit board to the flex circuit antenna resonating element, wherein the flex circuit antenna resonating element comprises a planar inverted-F antenna structure.

10. The portable electronic device defined in claim 9 wherein planar inverted-F antenna structure forms a first portion of a hybrid antenna for the portable electronic device and resonates in a first frequency band, wherein the antenna slot forms a second portion of the hybrid antenna and resonates in a second frequency band, wherein the first frequency band covers communications bands at 800 MHz and 900 MHz, and wherein the second frequency band covers communications bands at 1800 MHz, 1900 MHz, and 2100 MHz.

11. A portable electronic device, comprising:

a printed circuit board having a conductive region;

a flex circuit antenna resonating element; and a pin that electrically connects the conductive region on the printed circuit board to the flex circuit antenna resonating element, wherein the flex circuit antenna resonating element comprises a planar inverted-F antenna structure and wherein the planar inverted-F antenna element comprises a first conductive trace and a second conductive trace formed on a flex circuit substrate and comprises a backside trace that overlaps the first and second conductive traces and forms a series capacitance for the planar inverted-F antenna resonating element.

12. The portable electronic device defined in claim 11 wherein the planar inverted-F antenna structure forms a first portion of a hybrid antenna for the portable electronic device and resonates in a first frequency band, wherein the antenna slot forms a second portion of the hybrid antenna and resonates in a second frequency band, wherein the first frequency band covers communications bands at 800 MHz and 900 MHz, and wherein the second frequency band covers communications bands at 1800 MHz, 1900 MHz, and 2100 MHz.

13. A portable electronic device, comprising:

a printed circuit board having a conductive region;

a flex circuit antenna resonating element;

a pin that electrically connects the conductive region on the printed circuit board to the flex circuit antenna resonating element, wherein the pin comprises a spring-loaded pin;

a conductive bezel; and a spring that electrically connects the printed circuit board to the conductive bezel, wherein the flex circuit antenna resonating element comprises a planar inverted-F antenna structure and wherein the planar inverted-F antenna element comprises a first conductive trace and a second conductive trace formed on a flex circuit substrate and comprises a backside trace that overlaps the first and second conductive traces and forms a series capacitance for the planar inverted-F antenna resonating element.

14. The portable electronic device defined in claim 13 wherein the planar inverted-F antenna structure forms a first portion of a hybrid antenna for the portable electronic device and resonates in a first frequency band, wherein the antenna slot forms a second portion of the hybrid antenna and resonates in a second frequency band, wherein the first frequency band covers communications bands at 800 MHz and 900 MHz, and wherein the second frequency band covers communications bands at 1800 MHz, 1900 MHz, and 2100 MHz.

* * * * *